US008802211B2

(12) United States Patent
Cattacin et al.

(10) Patent No.: US 8,802,211 B2
(45) Date of Patent: Aug. 12, 2014

(54) METHOD FOR MANUFACTURING A SHEET PRODUCT FOR USE IN A DISPENSER AND STRIP OF SHEET PRODUCT

(75) Inventors: Gilles Cattacin, Colmar (FR); Pierre Laurent, Turckheim (FR); Julien Marietta-Tondin, Marckolsheim (FR); Remy Ruppel, Durrenentzen (FR); Ann M. Andres, Neenah, WI (US); Abby C. Case, Green Bay, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 127 days.

(21) Appl. No.: 13/359,254

(22) Filed: Jan. 26, 2012

(65) Prior Publication Data

US 2012/0237711 A1 Sep. 20, 2012

Related U.S. Application Data

(63) Continuation-in-part of application No. 12/513,004, filed as application No. PCT/FR2007/001737 on Oct. 22, 2007, now Pat. No. 8,298,640.

(30) Foreign Application Priority Data

Oct. 31, 2006 (FR) ..... 06 09546

(51) Int. Cl.
*A47K 10/16* (2006.01)

(52) U.S. Cl.
USPC ..... 428/43

(58) Field of Classification Search
USPC ..... 428/43
See application file for complete search history.

(56) References Cited

U.S. PATENT DOCUMENTS

| | | | |
|---|---|---|---|
| 390,328 | A | 10/1888 | Wheeler |
| 400,913 | A | 4/1889 | Hicks |
| 453,003 | A | 5/1891 | Hicks |
| 459,516 | A | 9/1891 | Wheeler |
| 511,983 | A | 1/1894 | Wheeler |
| 607,498 | A | 7/1898 | Wheeler |
| 2,007,544 | A | 7/1935 | Meisel |

(Continued)

FOREIGN PATENT DOCUMENTS

| | | | |
|---|---|---|---|
| DE | 20107189 | U1 | 7/2001 |
| DE | 20314147 | U1 | 12/2003 |

(Continued)

OTHER PUBLICATIONS

Nilsson, Ulrika and Wolme, Lisa; ReDesign of RollNap, a Technical and Aesthetical Development of a Napkin Dispenser; University Essay from Lunds Universitet/Maskinkonstruktion; LTH; 2010; 121 pages; http://www.essays.se/essay/1629aeca878/.

(Continued)

*Primary Examiner* — Alexander Thomas
(74) *Attorney, Agent, or Firm* — William W. Letson

(57) ABSTRACT

The invention relates to a method of manufacturing a web of sheet product, with a discontinuous perforation arrangement such that manufacture of a web of sheet product provides for an increase in the breaking strength of the web of sheet product while feeding the web in a machine direction, thereby reducing the risk of breaking and maintaining the yield and throughput of the production of the perforated web as an intermediate product, yet providing a low breaking force for individual strips produced from the web.

9 Claims, 4 Drawing Sheets

(56) References Cited

U.S. PATENT DOCUMENTS

| | | | | |
|---|---|---|---|---|
| 2,053,786 | A | | 9/1936 | Straubel |
| 2,328,109 | A | | 8/1943 | Thompson |
| 3,276,706 | A | | 10/1966 | House |
| 3,326,365 | A | | 6/1967 | Neureither et al. |
| 3,570,335 | A | | 3/1971 | Marin |
| 3,845,289 | A | | 10/1974 | French |
| 3,877,576 | A | | 4/1975 | Kishi et al. |
| 4,134,521 | A | | 1/1979 | Pecht |
| 4,236,679 | A | | 12/1980 | Jespersen |
| 4,317,547 | A | | 3/1982 | Graham, Jr. et al. |
| 4,378,912 | A | | 4/1983 | Perrin et al. |
| 4,403,748 | A | | 9/1983 | Cornell |
| 4,457,964 | A | | 7/1984 | Kaminstein |
| 4,521,209 | A | | 6/1985 | DuFresne |
| 4,552,315 | A | | 11/1985 | Granger |
| 4,627,117 | A | * | 12/1986 | Morishita ..... 4/244.2 |
| 4,648,530 | A | | 3/1987 | Granger |
| 4,651,895 | A | | 3/1987 | Niske et al. |
| 4,753,369 | A | | 6/1988 | Morrison |
| 4,756,485 | A | | 7/1988 | Bastian et al. |
| 4,807,824 | A | | 2/1989 | Gains et al. |
| 4,846,412 | A | | 7/1989 | Morand |
| 4,856,724 | A | | 8/1989 | Jespersen |
| 4,905,868 | A | | 3/1990 | Beane et al. |
| 4,944,466 | A | | 7/1990 | Jespersen |
| 5,205,454 | A | | 4/1993 | Schutz et al. |
| RE34,288 | E | | 6/1993 | Beck et al. |
| 5,244,161 | A | | 9/1993 | Wirtz-Odenthal |
| 5,496,605 | A | | 3/1996 | Augst et al. |
| 5,526,973 | A | | 6/1996 | Boone et al. |
| 5,582,362 | A | | 12/1996 | Johnson et al. |
| 5,704,566 | A | | 1/1998 | Schutz et al. |
| 5,785,274 | A | | 7/1998 | Johnson |
| 5,836,862 | A | | 11/1998 | Granger |
| 5,979,822 | A | | 11/1999 | Morand et al. |
| 6,010,090 | A | | 1/2000 | Bushmaker |
| 6,029,921 | A | | 2/2000 | Johnson |
| 6,059,711 | A | | 5/2000 | Wang |
| 6,090,467 | A | | 7/2000 | Yip |
| 6,109,473 | A | | 8/2000 | Neveu et al. |
| 6,145,779 | A | | 11/2000 | Johnson et al. |
| 6,145,782 | A | | 11/2000 | King et al. |
| 6,152,397 | A | | 11/2000 | Purcell |
| 6,228,454 | B1 | | 5/2001 | Johnson et al. |
| 6,237,871 | B1 | | 5/2001 | Morand et al. |
| 6,440,052 | B1 | | 8/2002 | Reider et al. |
| 6,447,864 | B2 | | 9/2002 | Johnson et al. |
| 6,460,727 | B1 | | 10/2002 | Irwin |
| 6,464,120 | B1 | | 10/2002 | Johnson et al. |
| 6,536,624 | B2 | | 3/2003 | Johnson et al. |
| 6,581,500 | B1 | | 6/2003 | Kietaibl |
| 6,592,067 | B2 | | 7/2003 | Denen et al. |
| 6,622,888 | B2 | | 9/2003 | Boone et al. |
| 6,736,348 | B1 | | 5/2004 | Formon et al. |
| 6,826,991 | B1 | | 12/2004 | Rasmussen |
| 6,838,887 | B2 | | 1/2005 | Denen et al. |
| 6,860,447 | B2 | | 3/2005 | Boone et al. |
| 6,871,815 | B2 | | 3/2005 | Moody et al. |
| 6,874,653 | B2 | | 4/2005 | Boone et al. |
| 6,884,209 | B2 | | 4/2005 | Roozrokh |
| 6,889,970 | B2 | | 5/2005 | Takahashi et al. |
| 6,892,898 | B1 | | 5/2005 | Boone et al. |
| 6,959,885 | B2 | | 11/2005 | King |
| 6,964,395 | B1 | | 11/2005 | Lewis et al. |
| 7,137,539 | B2 | | 11/2006 | Jackson |
| 7,168,602 | B2 | | 1/2007 | Broehl |
| 7,234,610 | B2 | | 6/2007 | Skarda et al. |
| 7,370,826 | B2 | | 5/2008 | Neveu |
| 7,416,162 | B2 | | 8/2008 | Behroozi |
| 7,832,678 | B2 | | 11/2010 | Hjort et al. |
| 7,837,077 | B2 | | 11/2010 | Formon et al. |
| 7,954,405 | B2 | | 6/2011 | Kling |
| 7,967,235 | B2 | | 6/2011 | Forman et al. |
| 7,971,514 | B2 | | 7/2011 | Alalu |
| 2005/0067519 | A1 | | 3/2005 | King |
| 2007/0098944 | A1 | * | 5/2007 | Mitchell, Jr. ..... 428/43 |
| 2008/0173661 | A1 | | 7/2008 | Neveu |
| 2008/0197142 | A1 | | 8/2008 | Langen et al. |
| 2008/0280088 | A1 | | 11/2008 | Baum |
| 2009/0155512 | A1 | | 6/2009 | Neto et al. |
| 2009/0212153 | A1 | | 8/2009 | Alalu |
| 2010/0075094 | A1 | | 3/2010 | Cattacin et al. |
| 2010/0114366 | A1 | | 5/2010 | Case et al. |
| 2010/0224647 | A1 | | 9/2010 | Formon et al. |
| 2011/0139920 | A1 | | 6/2011 | Formon et al. |
| 2011/0168831 | A1 | | 7/2011 | Mok et al. |
| 2011/0177278 | A1 | | 7/2011 | Neto et al. |
| 2011/0210137 | A1 | | 9/2011 | Kling |
| 2011/0226883 | A1 | | 9/2011 | Forman et al. |
| 2012/0138625 | A1 | | 6/2012 | Case et al. |
| 2013/0040089 | A1 | | 2/2013 | Cattacin et al. |

FOREIGN PATENT DOCUMENTS

| | | | |
|---|---|---|---|
| EP | 0865247 | B1 | 3/2002 |
| EP | 0930039 | B1 | 11/2002 |
| GB | 2377204 | A | 1/2003 |
| JP | 2003-144344 | A | 5/2003 |
| JP | 2005-065730 | A | 3/2005 |
| JP | 2009-039226 | A | 2/2009 |
| WO | 97/21377 | A1 | 6/1997 |
| WO | 98/37794 | A1 | 9/1998 |
| WO | 2006/007256 | A1 | 1/2006 |

OTHER PUBLICATIONS

International Search Report and Written Opinion of the International Searching Authority for PCT/US2013/025334 mailed May 15, 2013.
International Search Report and Written Opinion of the International Searching Authority for PCT/FR2007/001737; dated Oct. 31, 2008; 21 pages.

* cited by examiner

METHOD FOR MANUFACTURING A SHEET PRODUCT FOR USE IN A DISPENSER AND STRIP OF SHEET PRODUCT

CROSS-REFERENCE TO RELATED APPLICATIONS

This application is a continuation-in-part application of U.S. Pat. No. 8,298,640, filed on Apr. 30, 2009, which is the national stage entry of International Application No. PCT/FR2007/001737, filed on Oct. 22, 2007, which claims priority to French Application No. 06 09546, filed on Oct. 31, 2006 (now French Patent No. 2907654), the priorities of which are hereby claimed and their disclosures incorporated in their entireties herein by reference.

TECHNICAL FIELD

The present application generally relates to a method for efficiently manufacturing a strip of sheet product for use in dispensers, in particular for manufacturing rolls of an absorbent or non-absorbent product, such as paper towels, napkins, hand tissues, facial tissues, toilet papers, kitchen towels, wipers, placemats, and the like. Furthermore, the present application relates to a strip of sheet product for use in a dispenser.

RELATED ART

Manually operated dispensers for dispensing a sheet product, such as paper wipes, paper hand towels, bathroom tissues and the like, usually comprise a housing in which a source of the sheet product, e.g., a tissue paper roll or a tissue paper stack of a continuous strip of paper, is accommodated. In the case of the roll, the source of sheet product is a wound continuous strip of sheets. The single sheets constituting the roll are often connected to each other at perforation lines or precuts.

The housing of such a manually operated paper sheet dispenser usually comprises an opening to guide the loose end of a paper roll to the exterior of the housing. A user that intends to remove one or more paper sheets from the dispenser pulls at the loose end of the paper strip, i.e., an end sheet, until one of the perforation lines comes into a position in which the pulled paper sheet can be detached from the paper roll, for example by a quick tug. The dispenser opening of the manually operated dispenser can be slit-like, such that a paper sheet can be pulled out as an unfolded web and remains unwrinkled. Alternatively, the opening can be formed as a cone-shaped mouth, wherein the strip is pulled through a, e.g., substantially circular or oval opening, whereby the constricted paper is folded or crumpled so as to form a loose rope or rope-like form of paper. In each case, the sheets from the paper roll that have passed through the opening of the manually operated dispenser can be detached from the rest of the paper source inside the housing by an increased manual force, such that the paper sheet breaks at the perforation line that is closest to the opening of the dispenser outside of the housing.

A pulling force has to be applied to the wound sheets of the paper roll in order to pull them through the opening of the dispenser, thereby overcoming friction that occurs when the paper is unwound from the roll and guided through the opening. In order to allow withdrawal of the paper from the dispenser, the sheets do not break along a perforation line before the pulling force is high enough to overcome the friction. Furthermore, it should be assured that the sheets do not break along a perforation line that is still within the housing, or else operation of the dispenser is compromised and sheets are unavailable to the user.

When applying the pulling force, there is always the risk of breaking of the paper, in particular, at the points where the perforation lines separate the respective paper sheets. Hence, in view of the frictional forces, the dispenser design is adapted to the breaking strength of the paper strip and, in particular, to the breaking strength of the perforation lines. In other words, the breaking strength of the perforations defining a breaking force threshold is generally significantly higher than the pulling force that is required to pull the paper sheets out of the manually operated dispenser.

For dispensers having a cone-shaped opening for dispensing paper sheets, the overall friction applied to the paper strip which must be overcome by the pulling action of the user is dominated by the friction from the constricted opening. The necessary perforation breaking force threshold of current sheets and dispensers requires the user to pull the sheet with a significant force, which can render the overall process of withdrawing a paper sheet from the dispenser inconvenient.

Conventionally, in the manufacturing process of producing strips of a sheet product for use in dispensers, a web of a sheet product, such as a paper web, is processed in a continuous manner using a cutting head to create a perforation line in the paper web to be processed. The cutting head usually comprises a plain blade and a patterned perforation blade in order to cut the perforation across the full width of the paper web.

Usually, in order to increase the throughput of manufacturing, the width of the web is larger than the width of the paper rolls to be produced, such that after cutting the perforation lines and winding the web onto a core, i.e., log forming, the log is cut into parts to obtain paper rolls of a desired width. Furthermore, the machine feeding speed applies a constant tension force onto the fed web. Hence, the feeding speed is restrained to avoid exceeding the breaking strength of the web while feeding.

The desire to reduce the breaking force threshold of the perforation lines of the paper strip conflicts with the desire to increase or maintain the machine feeding speed, and raises significant issues in the manufacturing process. A high perforation (i.e., low bond ratio) and resulting low breaking force threshold could lead to breakage of the perforated paper web in the manufacturing process when the paper web is transferred to the reels to form a paper roll, especially when such a transfer is done at high speed and/or tension.

Paper rolls having a higher density (e.g., more tightly wound rolls) are generally desired in light of transportation and dispenser size considerations. As the density of the sheet roll reeled up on a log strongly depends on a tension of the paper web in a feeding direction, the breaking force threshold defined by the perforation lines should not fall below a certain threshold value to avoid a low density of sheets in the paper rolls.

Hence, there is a balance between a minimum breaking force threshold of the connected paper sheets implied by the manufacturing constraints and the dispenser design that defines the pulling force necessary to overcome the opposing force (e.g., friction) applied to the paper strip within the dispenser.

In document WO 2008/056042 A1, a method for producing a roll is disclosed. The roll is made of a succession of single-use absorbing paper sheets separated along at least one side thereof, perpendicular to the unwinding direction of the roll, by parallel precuts, the sheets being further separated by cuts extending along at least 80% of the cut side of the sheets, and the cuts and precuts alternating in the roll unwinding direction.

Document US 2009/0155512 A1 discloses a roll of a sheet material with elongated sheets within the roll that are either completely detached from each other or substantially completely detached from each other, such that the user can dispense the elongated sheets with one hand.

Furthermore, document US 2010/0075094 discloses a roll comprising a succession of sheets of absorbent paper separated along at least one of their sides perpendicular to a roll-unwinding direction by mutually parallel precuts, wherein the sheets are also separated by cuts, the cuts and precuts alternating in the roll-unwinding direction.

Document U.S. Pat. No. 6,010,090 discloses a method of perforating a web along a plurality of transverse lines, the lines of perforations being staggered; however, such perforations do not extend across transverse planes which correspond to the longitudinal lines of the web.

Document U.S. Pat. No. 2,053,786 discloses a method of forming paper rolls which are divided transversely; however, the paper is connected only at one marginal edge by narrow ties so as to avoid waste issues associated with the use of rolls not so completely severed.

In view of the above issues, the present invention provides a method for manufacturing a web and rolls of sheet product wherein the ability to withstand breaking during the manufacturing process is improved. Unlike conventional manufacturing methods, the invention is not confined to slower manufacturing speeds for making a paper web having such lower breaking forces.

SUMMARY OF THE INVENTION

These disadvantages are overcome by the method of manufacturing a web of sheet product, the method of manufacturing strips of sheet product, the web and the sheet product according to the present invention. It shall be noted that the sheet products may be absorbent or non-absorbent, such as paper towels, napkins, hand tissues, facial tissues, toilet papers, kitchen towels, wipers, placemats and the like. Other sheet products also can be made according to the present invention, irrespective of absorbency, including non-wovens, films (including polymeric film), and foil (including metallic film).

According to a first aspect a method for manufacturing a web of sheet product is provided. The method includes the following steps:

- feeding a web of sheet product in a machine feeding direction, the web being multiple widths of sheet product in breadth;
- creating perforations in the web of sheet product along a perforation line transverse to the machine feeding direction, so that a perforation is formed having a repeating pattern of cut portions and non-cut portions;
- cutting the web into strips of sheet product after creating perforations along the machine feeding direction, each strip having a predetermined width;
- wherein the web is partially perforated along the perforation line, so that at least one perforated segment provided with the perforation and at least one non-cut segment are alternately arranged along the perforation line,
- wherein each of the at least one perforated segments is associated to one or more strips to be produced and arranged on the web, such that the cutting of the web results in strips having a perforation along the width of each produced strip, and
- wherein at least one perforated segment has a length greater than and extends across the width of strip with at least one end of the at least one perforated segment extending into the material of web that corresponds to an adjacent strip of sheet product, so that the step of cutting the web results in strips having a perforated side-cut at least at one edge of the strip between two spaced perforation lines of the respective strip.

Furthermore, a plurality of perforation lines may be spaced in the machine feeding direction, wherein at least one perforated segment and at least one non-cut segment are staggered in the machine cross direction.

Except where express by context, it is intended that the terms "across" or "extends across" contemplates not only those embodiments having perforation lines that extend from one side to the other of the web or strip but also those that extend substantially from one side to the other of the web or strip.

It is one intention of the above method for manufacturing strips of sheet product to provide for a reduction in the perforation breaking strength of the strips of sheet product while not adversely affecting the production constraints of the manufacturing process, more specifically, to provide for a decreased breaking strength of the strips of sheet product while maintaining the yield and throughput of the production of the strips from a web of sheet product while providing a web product that provides for high or higher speed production rates relative to a sheet product with continuous perforations extending across the entire web.

Stated another way, the method of manufacturing a web of sheet product according to the present invention provides for an increase in the breaking strength of the web of sheet product while feeding relative to a sheet product with continuous perforations extending across the entire web, thereby reducing the risk of breaking and maintaining the yield and throughput of the production of the perforated web as an intermediate product. To overcome the risk of breaking of the web while feeding it between the stages of creating the perforation lines and, e.g., reeling the web to obtain a log, perforated segments are only present along a portion of the perforation line. Hence, the web is partially perforated along each perforation line, wherein perforated segments and non-cut segments are alternately arranged along the perforation line. This is achieved by cutting the perforations in segments having a smaller width than the web to be processed, such that the perforations are cut only partially across the overall width of the web. The breaking strength of the fed web is increased and the tension load in the machine feeding direction of the web, which is necessary for achieving a sufficient density of sheet product on the log, is thereby substantially borne by the non-cut segment(s) along the perforation line. Moreover, as the breaking strength is increased, the above method allows for increased machine feed speed and has a positive impact on the throughput of the manufacturing process. Desirably, the web machine feed speed is at least 300 ft/min in the present invention.

It may be provided that the length of the sheet product between non-cut segments (in the machine direction) is larger by a factor of two or more than the width of a non-cut segment.

It may be provided that the length of a perforated segment is larger by a factor of two or more than the length of a non-cut segment.

According to a further aspect, a method for manufacturing strips of sheet product, in particular for use as paper towels, napkins, hand tissues, facial tissues, toilet papers, kitchen towels, hand towels, wipers, placemats, and the like, is provided. The web has perforated segments the length of which is selected such that the collective length of the at least one perforated side-cut is between 1% to 20%, and more desirably 2% to 20%, of the width of each strip of sheet product.

Generally, the web will be cut into strips after the web is wound as a log, however, a slitter could also be used prior to winding onto a roll. The cutting of the web may be carried out such that each strip has a width that substantially corresponds to the length of the perforated segments.

The length of the perforated segments may be selected such that the collective or sum length of the perforated side-cuts for each sheet product is greater than zero and less than 25%, and more desirably between 1% and 20% of the width of each strip of sheet product upon which the side-cut is located.

According to an embodiment, the bond ratio of a perforated segment may be equal to or lower than 15%. Desirably, the bond ratio is equal to or less than about 12%, and even more desirably between about 4% and about 11%, including, but not limited to, bond ratios of about 4.5%, about 5.5%, about 6.4%, about 7.2%, about 8.9%, and about 10.6% and ranges there between, wherein the bond ratio in a given perforation section is a relation between the non-cut portions and the overall length of the perforation section.

Furthermore, the perforated segment may have at one or both ends a perforation portion that has a bond ratio that differs from the rest of the perforated segment.

The web may be provided with a separation cut or perforation after the step of creating the offset perforated segments, wherein the separation cut or perforation has a bond ratio that is adapted to have a breaking strength which is lower than the breaking strength of the perforation line.

After the perforating steps, the web can be reeled up to form a log of sheet product, wherein the log may be severed to obtain strips or rolls of sheet product. Alternatively, the strip of sheet product may be folded along its longitudinal extension, so that the sheets are stacked onto each other to form a sheet stack (e.g., with napkins or towels).

According to a further aspect, a web of sheet product is provided with spaced perforation lines transverse to its longitudinal extension or orientation, wherein along each perforation line the web has at least one perforated segment and at least one non-cut segment that are alternately arranged along the perforation line, wherein at least one perforated segment has a perforation with a repeating pattern of cuts or perforation portions and connecting tabs or non-cut portions, and wherein the web has a breadth of at least three strips, each strip having a predetermined width, each perforated segment being associated with one or more of the strips to be disposed from the web, at least two adjacent perforated segments along the same perforation line extending across the respective strip width of web in a direction transverse to the longitudinal extension, and further extending along the web of sheet product to create perforated side-cuts, and wherein the perforated side-cuts have a length of between 1% to 25%, and more desirably 4% to 20%, of the predetermined strip width.

According to a further aspect, a source of sheet product for use in a dispenser is provided including a strip of sheet product having sheets connected by an unbroken perforation line or perforation segment, wherein perforated side-cuts are provided along a longitudinal extension of the strip at least at one edge of the strip.

Moreover, the perforated side-cuts may be arranged between two spaced perforation lines along a longitudinal extension of the strip, desirably equally spaced from the perforation lines.

BRIEF DESCRIPTION OF THE DRAWINGS

Other features and advantages of the present invention will become apparent when reading the following detailed, yet not limiting, description, for the understanding of which reference will be made to the attached drawings, in which.

DESCRIPTION OF EMBODIMENTS

Reference in detail will now be made to non-limiting embodiments of the invention, examples of which are illustrated in the accompanying drawings. Wherever possible, the same reference number has been used throughout the drawings and the following detailed description to refer to the same or similar parts.

Figure 1:
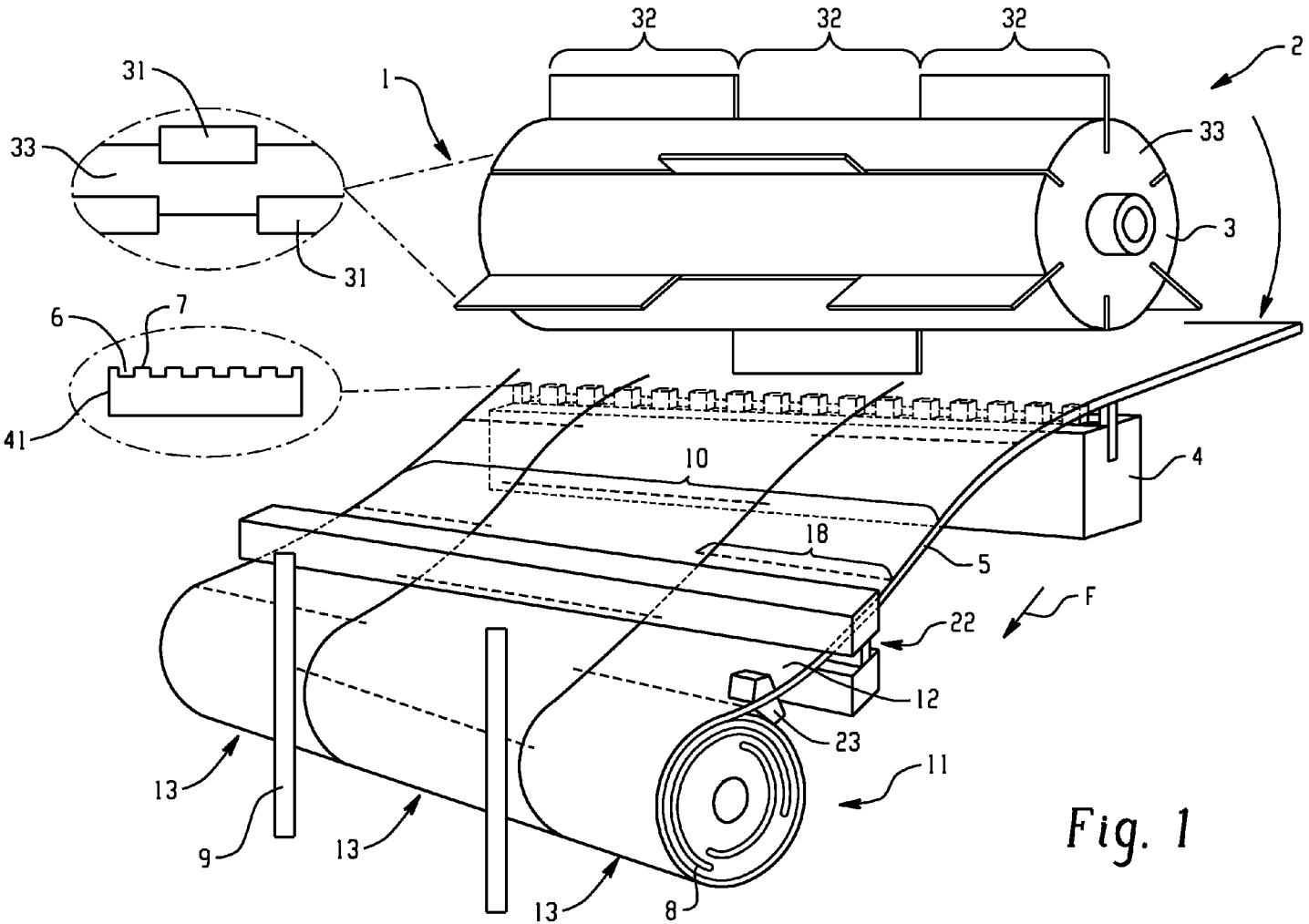
FIG. 1 schematically illustrates the process of forming or cutting perforations into a fed paper web and its reeling up to form a log.
Figure 2:
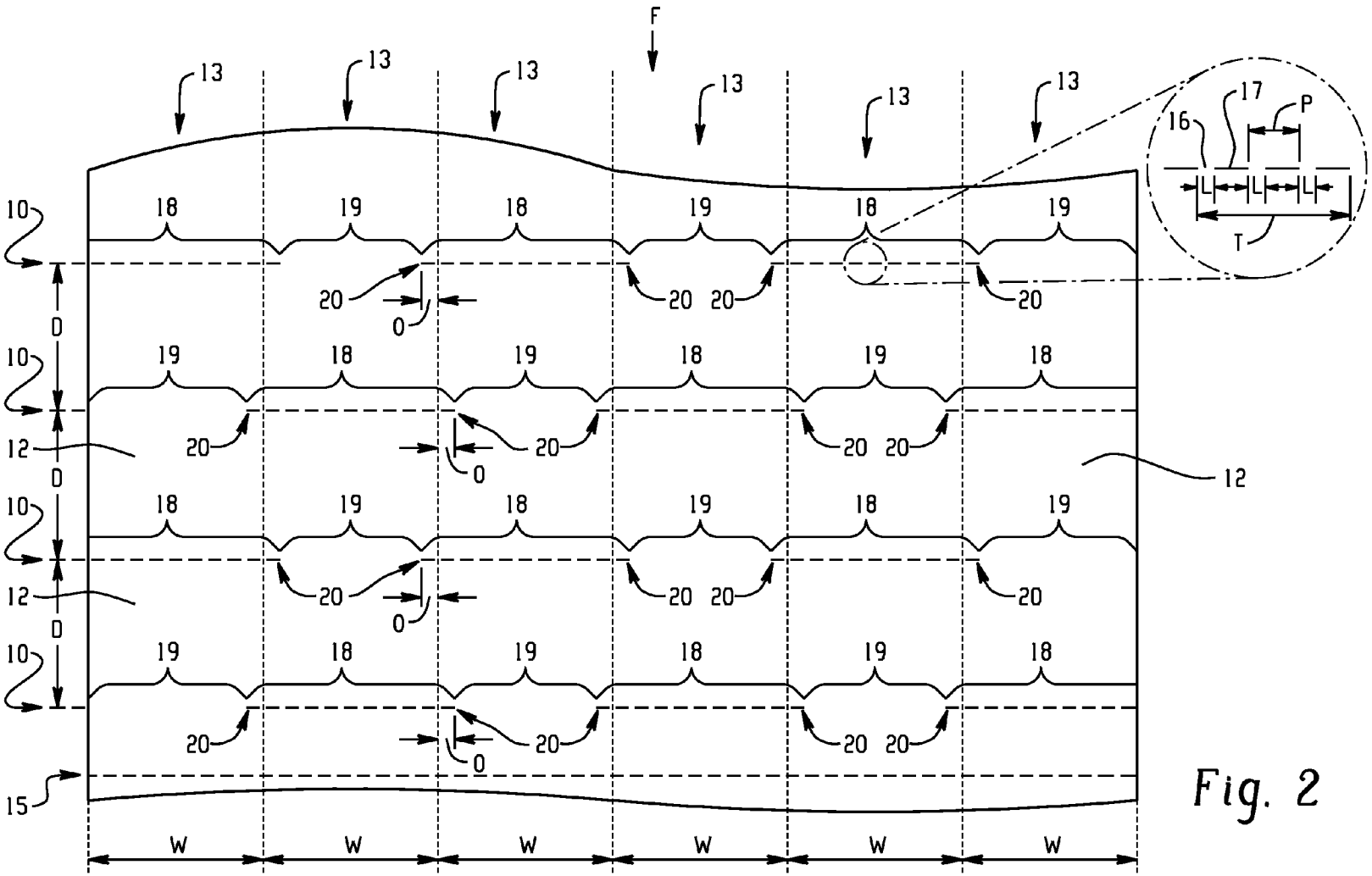
FIG. 2 shows a basic view of an unwound web including perforations resulting from the manufacturing method according to an embodiment.
Figure 3:
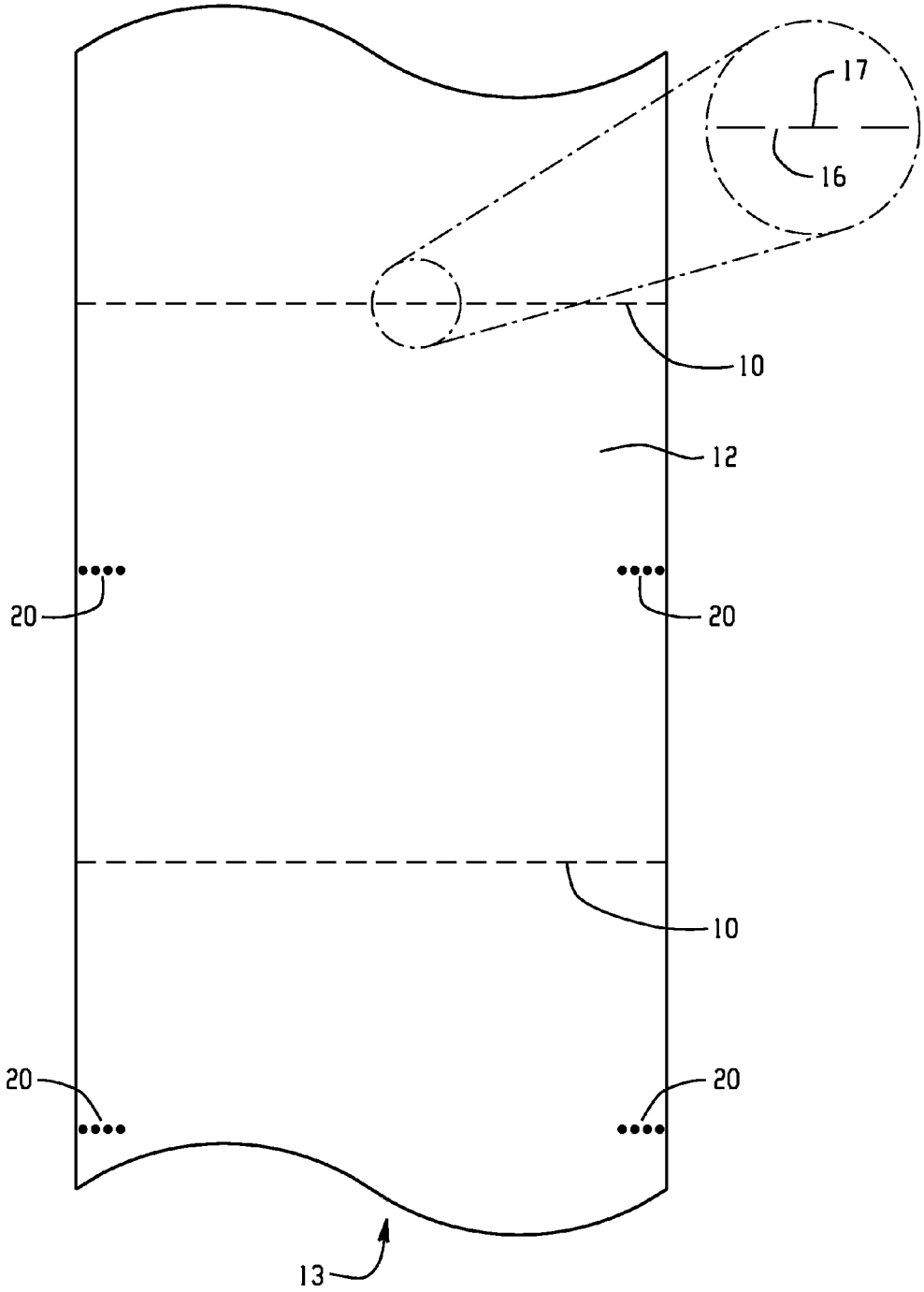
FIG. 3 shows a basic view of an unwound paper strip including perforations resulting from the manufacturing method according to an embodiment.

FIG. 1 is a schematic representation of a portion of a manufacturing system 1 for producing a roll of sheet product from a basic web 5 of sheet product and further illustrates a method for manufacturing strips 13 of sheet product. The web of sheet product may, e.g., be a paper web 5 made of absorbent paper used for paper towels, napkins, hand tissues, facial tissues, toilet papers, kitchen towels, hand towels, wipers, placemats, and the like. As an alternative to paper, any woven or non-woven absorbent material that is suitable to serve as a cleaning or drying sheet, or any non-absorbent material that is suitable to serve as a cleaning or drying sheet may be used. FIG. 2 shows a basic view of a perforated paper web produced by the manufacturing system 1 before the paper web 5 is severed to produce the source of paper sheets to be accommodated in a dispenser. FIG. 3 shows a plain view of an unwound paper strip 13 produced by the manufacturing system 1 before the paper strip 13 is rewound or folded to produce the source of paper sheets to be disposed in a dispenser.

The manufacturing system 1 comprises a cutting head unit 2 through which the paper web 5 is passed in a machine feeding direction F in order to provide it with perforated segments 18 along perforation lines 10. The illustrated cutting head unit 2 has a rotary head 3 and a stationary perforating head 4. As illustrated, the stationary perforating head 4 is provided with a perforation blade 41, and the rotary head 3 is provided with a plain blade 31, which are both illustrated in a larger scale at the upper left of FIG. 1. It will be appreciated that in other embodiments, the stationary head 4 may be provided with a plain blade 31, and the rotary head 3 may be provided with a perforation blade 41.

Each perforation blade 41 is comprised of non-perforating or non-cutting blade portions 6 and perforating blade portions 7 which define the pattern of the perforations. As shown in FIGS. 2 and 3, perforations on the web 5 are alternately arranged tab or non-cut portions 16 and cut or perforated portions 17 that are created by the cutting head unit 2 as it rotates and the plain blade 31 contacts the perforation blade 41. Perforation as used herein is defined as an alternating, repeating or randomized pattern of a plurality of cut portions 17 and a plurality of tab or non-cut portions 16.

The perforations may be alternating or repeating in nature (e.g., A-B-A-B or A-B-C-A-B-C, A-B-B-A, A-B-C-C-B-A).

It should be appreciated that while alternating or repeating patterns of perforations may be desirable, the present invention is also intended to include randomized perforation patterns so long as the overall bond percent or ratio is satisfied. For convenience of discussion herein, randomized perforation patterns will be included in the terms "repeating" or "alternately arranged."

The characteristics of perforations can be defined by its bond ratio and the individual bond widths. The bond ratio is defined by the summed lengths L of each tab or non-cut portions 16 within a total length T of a given perforation segment 18. In other words, the bond ratio in a given perforation segment is a relation between the non-cut portions 16 to the overall length of the perforated segment 18. Based on the disclosure herein, it will be appreciated that some variation in the calculation of the bond ratio may result depending on the presence (or lack thereof) of a fading perforation portion and whether the segment is measured as formed or as cut. For purposes of this disclosure, bond ratios are measured within a perforation segment 18. To the extent a fading perforation portion is present at one or both ends of the perforation segment, the bond ratio calculation shall be calculated excluding the fading perforation portions from the segment.

The bond ratio of the perforations produced by the cutting head unit 2 is equal to or less than 20%. Desirably, the bond ratio is equal to or less than about 15%, more desirably equal to or less than about 12%, and more desirably between about 4% and about 11%, including, but not limited to, bond ratios of about 4.5%, about 5.5%, about 6.4%, about 7.2%, about 8.9%, and about 10.6% and ranges there between. Furthermore, perforation step length P, which is the total length of just one cut portion 17 and just one neighboring or adjacent tab or non-cut portion 16 is desirably between 1 mm and 20 mm.

In the illustrated embodiment, the paper web 5 is fed through the cutting head unit 2 at a certain speed while the rotary head 3 is rotating. The perforation blade 41 in the stationary perforating head 4 and the plain blade 31 in the rotary head 3 periodically strike, thereby cutting perforation lines 10 into the paper web 5 with a predefined spacing D in the machine feeding direction F. Thereafter, the paper web 5 is fed to a reeling stage 11 and reeled onto a core to obtain a paper log 8. If the paper log 8 has reached its final size it may be severed from the fed web 5 and then cut by a saw 9 or other suitable separating instrument to obtain paper rolls or strips of a desired width W. Strip widths W are generally uniform across a particular web, however, it will be appreciated that the strip widths across a web may not all be the same or none may be the same.

In the illustrated embodiment, the plain blades 31 of the rotary head 3 are directed outwardly from a carrier 33 and are equally spaced from each other regarding a circumferential direction thereof. Each plain blade 31 extends along the axial direction of the rotary head 3. When the plain blade is in the rotary head, it is contemplated that one of two blade configurations will be used. The first configuration has multiple blades spaced at a fixed (no cut) interval, while the second configuration utilizes a single blade with relief where no cut is desired.

In the illustrated embodiment, the plain blades 31 are arranged in blade segments 32; their width and their axial positions on the web 5 depend on the desired widths W of the paper rolls to be produced. Each blade segment 32 is desirably associated with one paper strip 13 to be produced, and more preferably, one paper strip 13 and at least a portion of one of the adjacent neighboring paper strips 13 to be produced. While the rotary head 3 has a width corresponding to at least the width of the paper web 5 to be processed, the plain blades 31 arranged at circumferential positions have reduced lengths in the axial direction of the rotary head 3 so that they are adapted to only partially cut the web 5 at the perforation lines 10 in perforated segments 18 along the overall width of the paper web 5. The perforations are shown as alternating along a perforation line 10 so that each perforated segment 18 on the web 5 has at least one neighboring or adjacent non-cut segment 19. Axially adjacent plain blades 31 are offset or staggered with respect to a rotational direction, such that the blades 31 do not cut a continuous perforation along the perforation line 10 extending along the overall width of the paper web 5.

The plain blades 31 may have axial lengths which are each slightly larger than the axial width of one respective segment 32 or an have multiple blades that when combined form an integral piece having the axial width of one respective blade segment 32 they are associated to, such that sheets 12 of each of the paper strips 13 are separated by a continuous perforation line 10 corresponding to the perforated segments 18.

Figure 4:
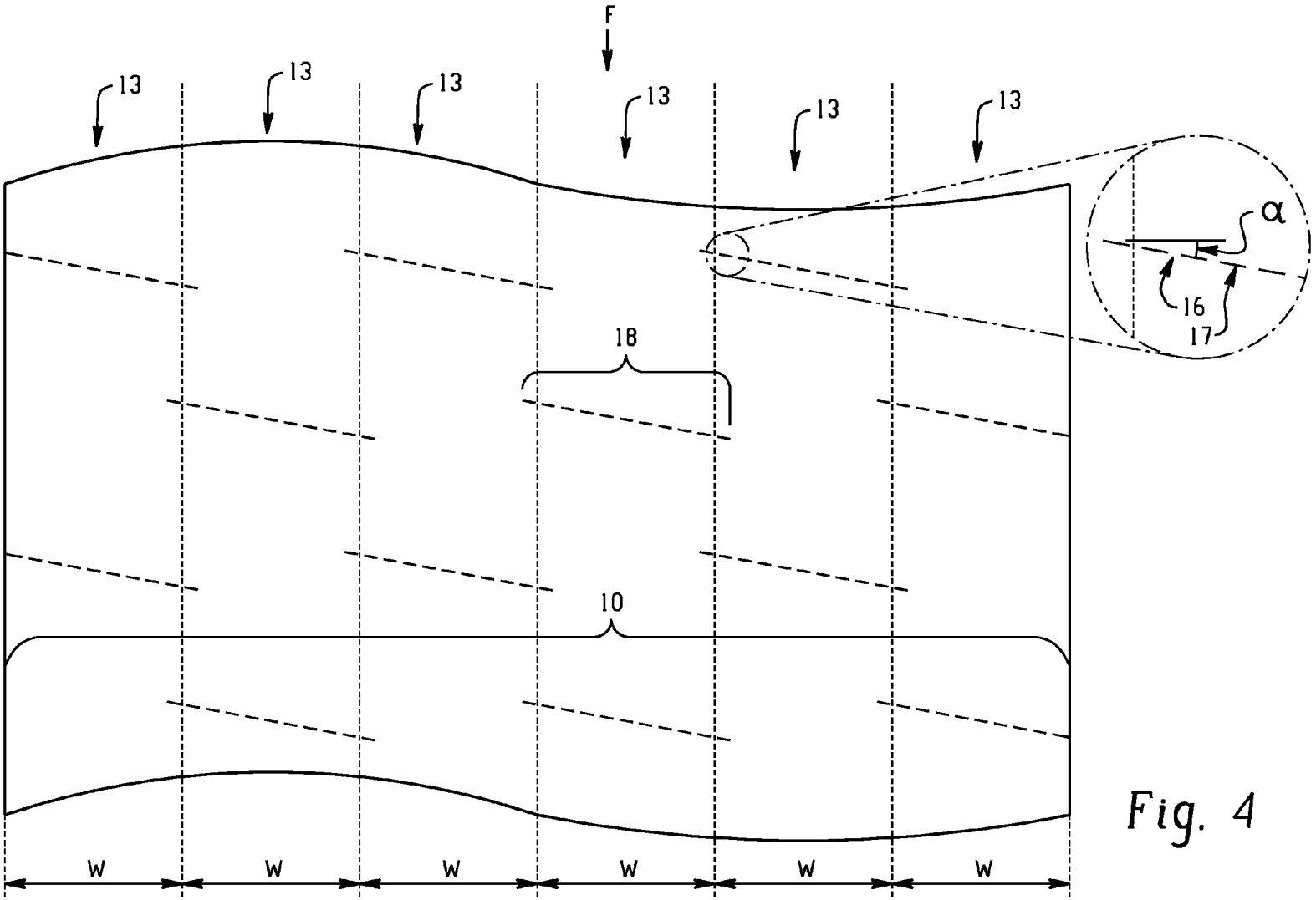
FIG. 4 shows an alternate perforation arrangement wherein perforation lines disposed on the web are skewed relative to the machine direction of the web as they extend across the web.

The plain blades 31 of the rotary head 3 can be provided in different configurations. The configuration shown in FIG. 1 shows three plain blades 31 along the circumferential direction of each blade segment 32, wherein the plain blades 31 for neighboring blade segments 32 are offset such that one plain blade 31 is placed at a circumferential position which is in between two plain blades 31 associated with a neighboring blade segment 32. The number of plain blades 31 associated with one blade segment 32 can also be one, two, three or more, depending on the rotation speed of the rotary head 3, the feeding speed of the paper web 5 and the desired sheet length of the single sheets 12 that form the strip 13 to be reeled up on the paper roll. It will be appreciated that the term "transverse" is intended to include perforation line(s) disposed perpendicularly or substantially perpendicularly on a web or strip relative to the machine direction, as well as perforation lines disposed on a strip or web in a non-perpendicular fashion relative to the machine direction. As such, FIG. 4 shows perforated segments 18 at an acute angle $\alpha$ from a line perpendicular to the longitudinal orientation of the web 5.

In the illustrated embodiments, if the perforated segments 18 have a length that is larger than the width W of the strip 13 associated therewith, the perforated segments 18 will extend or overlap a distance O into material which will ultimately form another strip 13 from the web 5. In addition to other advantages, the overlap perforation allows for manufacturing tolerances when cutting the log 8 to obtain paper rolls. Thus, the step of cutting, slitting, or sawing the web 5 may result in strips 13 with a perforated side-cut 20 at least at one edge of the strip 13 between two spaced perforation lines 10 of the respective strip 13.

Furthermore, wherein two adjacent perforated segments 18 along a perforation line 10 (with a non-cut segment there between) overlap the intermediate non-cut segment 19 in a direction transverse to the longitudinal extension, the collective length of the overlapping perforations is desirably between 1% and 25% of the width of the strip. More desirably, the combined length of the side-cuts on a sheet is at least 4% but less than 20% of the sheet or strip width W, and more desirably 5% to 16% of the strip width W. The overlap length may be adapted to the usual tolerances of the cutting equipment for cutting the log 8 into strips. One embodiment of the present invention contemplates a tissue product where the sheet is approximately 10.2 cm in width and wherein the perforated side-cuts 20 extend inward approximately 1 cm for each side edge.

The perforated side-cuts 20 may have a bond ratio equal to, less than, or higher than the bond ratio of the perforated segment 18. According to one embodiment, each perforated segment 18 has a length that is slightly more than the width of one strip 13, wherein the bond ratio increases towards the ends of the perforated segments 18 in a perforation fading portion. In other words the bond ratio of the perforation fading portion would be higher than the bond ratio of the rest of the respective perforated segment 18. As discussed below, it will be appreciated that this may be achieved by perforation bond gradient or a perforation at a fixed ratio that differs from the adjacent portion of the perforated segment. The perforation fading portion may have a width substantially corresponding to the overlap O that forms the side-cuts 20. The side-cuts 20 formed may thereby have reduced visibility, making them less noticeable to a consumer. Moreover, in an embodiment, the perforation step length (see e.g., non-cut portion 16) of the perforation fading portion can be reduced to an average of 0.5 to 5 mm.

In another embodiment, a lower fading perforation may be desirable. To achieve a lower fading perforation portion, the length of the individual perforations or cuts 17 may be shortened. Alternatively, the length of the tabs 16 between the individual perforations or cuts 17 may be lengthened thereby changing the frequency of the individual perforations or cuts 17 along a perforated segment 18. It will also be appreciated that the spacing or size of perforation cuts 17 and/or tabs 16 may be uniform across a perforation segment 18 or the cuts 17 and tabs 16 may vary. The inventors of the present invention also discovered that the location of one or more larger tabs 16 within a perforated segment 18 can provide increased perforation strength yet still allow for the separation desired when dispensed.

As to the paper strips 13 so produced, sheets are connected by an intact or unbroken perforation line formed in part by the perforated segments 18, wherein perforated side-cuts 20 are provided along at least at one edge of the longitudinal extension of the strip 13. The perforated side-cuts 20 may be arranged at the ends of a perforated segment 18 along the longitudinal extension of the strip 13. Since the side-cuts 20 are perforated but not fully cut, folding of edges of the sheets in subsequent process stages may be prevented, thereby maintaining high product quality.

The cutting of the paper log 8 may be carried out, e.g., by way of a log saw in order to obtain paper rolls 13. Common widths of the strips 13 of a napkin product obtained after cutting the log 8 are between 10 cm and 30 cm, desirably between 14 cm and 22 cm, and most desired between 15 cm and 19 cm. The saw-cutting is desirably performed within a position of the log 8 disposed within the range of the overlap O. It will be appreciated that desired strip widths may vary based on the type of product and/or its intended use.

As shown in FIG. 2, to allow a separation of a log 8 (or readily perforated web 5 of predetermined length) from the fed web 5 after the web 5 has been perforated with a predetermined length, the web 5 can be provided with a separation perforation 15 after the initial step of perforating. The separation perforation 15 is typically made in addition to the cutting of the perforation lines 10. The separation perforation 15 desirably has a bond ratio that is equal to or less than the bond ratio of the perforated segments 18. In particular, the bond ratio of the separation perforation 15 is equal to or less than 15%. More desirably, the bond ratio is equal to or less than about 12%, and even more desirably between about 4% and about 11%, including, but not limited to, bond ratios of about 4.5%, about 5.5%, about 6.4%, about 7.2%, about 8.9%, and about 10.6% and ranges there between. To make the separation perforation 15 where the web 5 breaks when the tension force is increased, the total breaking strength of the separation line 15 needs to be lower than the total breaking strength of the perforation line 10 including the perforated and non-cut segments 18, 19, respectively.

As shown in FIGS. 1 and 2, the separation perforation 15 (FIG. 2) may be made by a further cutting tool 22 (FIG. 1) at a stage before the web is wound up onto the log 8 (FIG. 1). The cutting tool 22 has a perforation knife and an anvil knife that are engaged to create the separation perforation 15, e.g., depending on the length of web wound up on the log 8, repeatedly after a predetermined number of perforation lines 10, periodically, or in some similar fashion.

To fully separate the log 8 from the fed web 5, the feeding of the web 5 may be slowed or shortly braked after the separation perforation 15 is introduced. The fed web 5 may be slowed by a rubber tool 23 or the like that is arranged between the log 8 and the cutting tool 22. The rubber tool 23 may briefly engage the fed web 5 just after the separation perforation 15 has passed through such that a separation force is applied to the separation perforation 15 to break it. The action of the rubber tool 23 should be synchronized with the action of the cutting tool 22.

The separation force results from continuously winding up the paper web 5 to the log 8 with the machine feeding speed and the sudden stop applied on the fed web 5 by the rubber tool 23 such that the separation force leads to the breaking of the web at its weakest position, along the separation perforation 15. The separation perforation 15 avoids, when applying the separation braking, the web breaking irregularly along the perforated segments 18 leading to a skewed, non-straight separation edge.

In an alternative embodiment, the rotation of the log 8 can be briefly accelerated after the separation perforation 15 is made, thereby applying an increased tension force onto the web resulting in a breaking along the separation perforation 15.

The separation perforation 15 may be aligned with the perforation lines 10; however, in some manufacturing processes, it is desirable that the separation perforation 15 not be aligned with the perforation lines 10 so that the separation perforation 15 does not have such a low breaking strength that breaking may occur before separation is intended (e.g., the rubber tool is applied). In another embodiment, it is contemplated that a distance of sheet product prior to the end of production roll would not have any perforations on the outermost layer or layers so as to avoid unintentional tearing during the log cutting and/or transfer of the log.

The above manufacturing process allows the production of rolls of sheet product having a significantly reduced bond ratio with no substantial impact on the density of the strip rolls and the reliability of the manufacturing process. The reduced bond ratio substantially decreases the breaking force necessary to tear a sheet off the strip, which allows omitting or substantially reducing the friction or other opposing force intentionally embodied in conventional dispensers.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

REFERENCE LIST

1 manufacturing system
2 cutting head unit
3 rotary head
4 stationary perforation head
5 web
6 cutting blade portion
7 non-cutting blade portion
8 log
9 log saw
10 perforation line
11 reeling stage
12 sheet
13 strip
15 separation perforation
16 tab or non-cut portions
17 perforated portions
18 perforation segments
19 tab or non-cut segments
20 side-cut
22 cutting tool
23 rubber tool
31 plain blades
32 blade segment
33 carrier
41 perforation blade
O overlap
F machine feeding direction
D spacing
W width of strip
L length of non-cut portion
T total length of a given perforation section
P perforation step length

The invention claimed is:

1. A web of sheet product having spaced perforation lines transverse to its longitudinal orientation, wherein along each perforation line the web has at least one perforated segment and at least one non-cut segment that are alternately arranged along the perforation line, wherein the at least one perforated segment has a perforation with a repeating pattern of cut portions and non-cut portions, and wherein the web has a breadth of at least three strips, each strip having a predetermined width, wherein each perforated segment is associated with one or more of the strips to be disposed from the web, at least two adjacent perforated segments along the same perforation line extending across the respective strip width of web in a direction transverse to the longitudinal extension, and further extending along the web of sheet product to create perforated side-cuts, wherein the perforated side-cuts have a length of between 1% to 25% of the predetermined strip width.

2. The web according to claim 1, wherein the web is provided with a separation perforation, wherein the separation perforation has a bond ratio that is lower than the bond ratio of the perforated segment.

3. The web according to claim 1, wherein the web is manufactured at a web fed rate of at least 300 ft/min.

4. The web according to claim 1, wherein the predetermined sheet widths are not all the same.

5. The web of claim 1, wherein a perforation line extends across the entire width of the width of the strip.

6. A source of sheet product for use in a dispenser, including a strip of sheet product having sheets connected at an unbroken perforation line, wherein along the longitudinal extension of the strip and spaced apart from the unbroken perforation line, perforated side-cuts are provided at least at one edge of the strip and wherein the perforated side-cuts have a combined length of between 1% to 25% of the width of each strip of sheet product and wherein the perforated side-cuts have a bond ratio equal to or less than the bond ratio of a perforated line from which it extends.

7. Source of sheet product according to claim 6, wherein the perforated side-cuts are arranged between two spaced perforation lines along the longitudinal extension of the strip.

8. Source of sheet product according to claim 6, wherein the strip of sheet product is wound to form a roll.

9. Source of sheet product according to claim 6, wherein the strip of sheet product is folded along its longitudinal extension, so that the sheets are stacked onto each other to form a sheet stack.

* * * * *